US005865151A

United States Patent [19]

Fukaya et al.

[11] Patent Number: 5,865,151

[45] Date of Patent: Feb. 2, 1999

[54] VALVE TIMING CONTROL APPARATUS FOR INTERNAL COMBUSTION ENGINE

[75] Inventors: Shunsuke Fukaya; Kenji Ueda, both of Kariya; Michio Adachi, Obu, all of Japan

[73] Assignee: Denso Corporation, Kariya, Japan

[21] Appl. No.: 64,789

[22] Filed: Apr. 23, 1998

[30] Foreign Application Priority Data

Apr. 25, 1997 [JP] Japan ..... 9-108890

[51] Int. Cl.[6] ..... F01L 1/344

[52] U.S. Cl. ..... 123/90.17; 123/90.31; 123/90.37; 74/568 R; 464/2

[58] Field of Search ..... 123/90.15, 90.17, 123/90.31, 90.37; 74/567, 568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,361,735 | 11/1994 | Butterfield et al. | 123/90.17 |
| 5,450,825 | 9/1995 | Geyer et al. | 123/90.17 |
| 5,520,145 | 5/1996 | Nagai et al. | 123/90.17 |
| 5,540,197 | 7/1996 | Golovatai-Schmidt et al. | 123/90.17 |
| 5,666,914 | 9/1997 | Ushida et al. | 123/90.17 |
| 5,724,929 | 3/1998 | Mikame et al. | 123/90.17 |
| 5,738,056 | 4/1998 | Mikame et al. | 123/90.17 |

FOREIGN PATENT DOCUMENTS 2302391 1/1997 United Kingdom .

*Primary Examiner*—Weilun Lo
*Attorney, Agent, or Firm*—Nixon & Vanderhye P.C.

[57] ABSTRACT

A valve timing control apparatus which regulates the movement of an abutting portion in a constraint-free state and prevents the collision between the abutting portion and other members to thereby suppress the generation of hammering sounds. A stopper piston constrains relative rotation between a shoe housing and a vane rotor by being fitted into a taper hole at its most lagged position. Oil pressure chambers apply an oil pressure to the stopper piston in a constraint release direction between the stopper piston and the taper hole. At the most lagged position, a back pressure chamber communicates with an oil lubrication space through communication passages. When the vane rotor is rotated from the most lagged position to an advanced side relative to the shoe housing, the pressure receiving area of a forward end portion of the stopper piston in contact with the oil pressure chamber decreases. On the other hand, communication between the communication passages is interrupted. As a result, the collision of the stopper piston against other members in the constraint-free state is suppressed and the generation of hammering sounds is suppressed.

15 Claims, 7 Drawing Sheets

FIRST EMBODIMENT

FIRST EMBODIMENT

SECOND EMBODIMENT

THIRD EMBODIMENT

FOURTH EMBODIMENT

FIG. 9 FIFTH EMBODIMENT
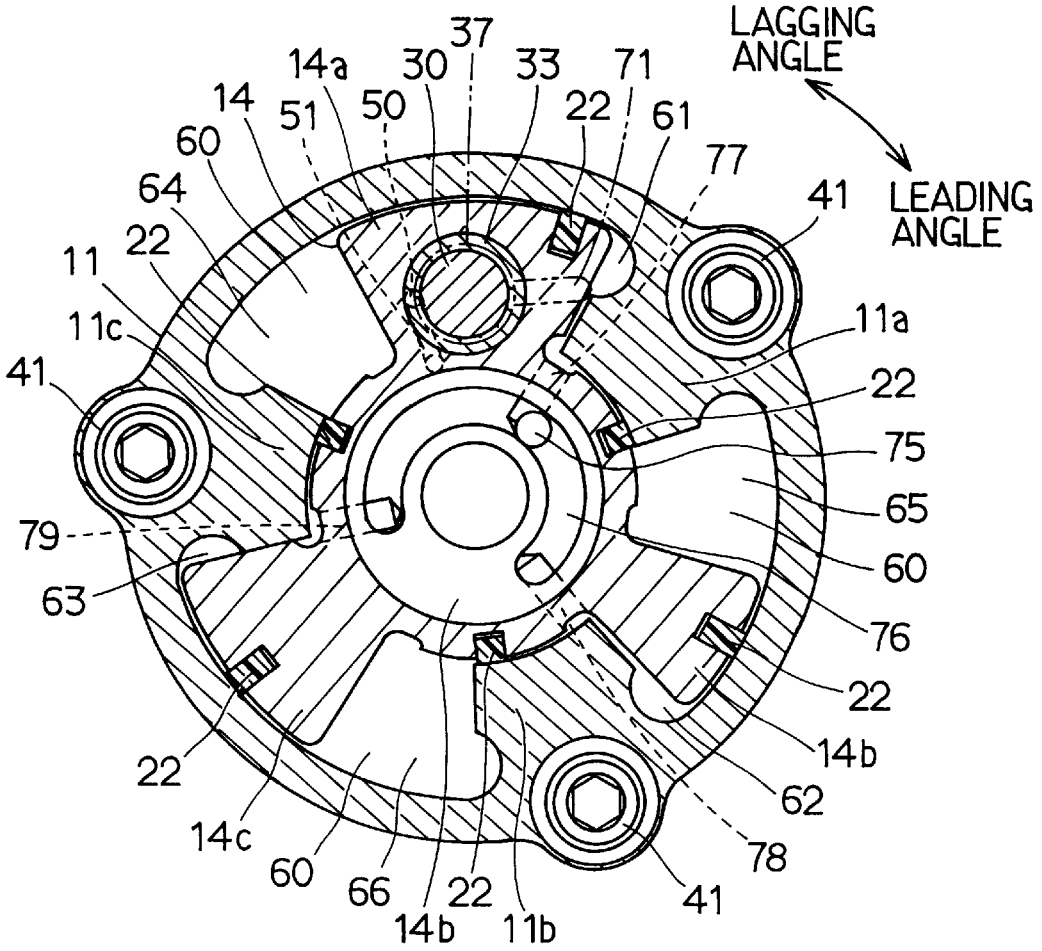
FIG. 10
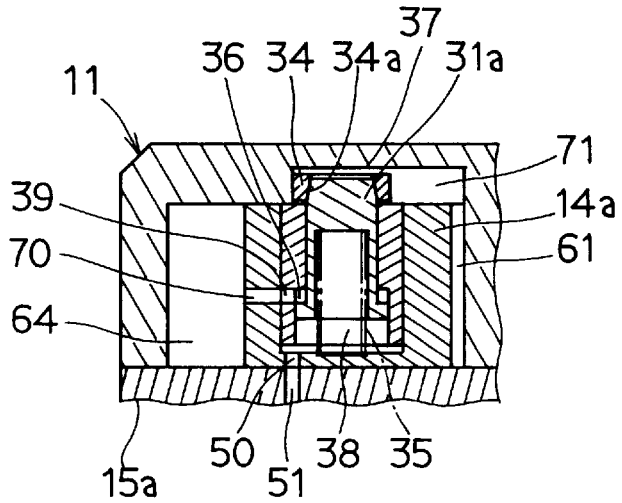

VALVE TIMING CONTROL APPARATUS FOR INTERNAL COMBUSTION ENGINE

CROSS-REFERENCE TO RELATED APPLICATION

This application is related to and claims priority from Japanese Patent Application No. Hei 9-108890, filed on Apr. 25, 1997, the contents of which are hereby incorporated by reference.

BACKGROUND OF THE INVENTION

1. Field of the Invention

The present invention relates to a valve timing control apparatus which is adapted to control the valve timing of at least one of a suction valve and an exhaust valve of an internal combustion engine according to operational conditions thereof.

2. Description of Related Art

A conventional vane type valve timing control apparatus includes a cam shaft that is driven through a timing gear or chain sprocket, and that rotates synchronously with a crank shaft of the engine. The apparatus thereby controls the valve timing of at least one of a suction valve and exhaust valve by the phase difference, due to a relative rotation, between the timing gear and the chain sprocket. Such an apparatus is disclosed in U.K. Patent Application Laid-Open Publication No. 2302391.

In this vane type of valve timing control apparatus there is, for example, a lock member that is reciprocatingly accommodated in a vane rotor constituting a cam shaft side rotating body. The lock member is fitted into a hole provided in a housing constituting a crank shaft side rotating body, thereby constraining the relative rotation between the cam shaft side rotating body and the crank shaft side rotating body. By constraining of the relative rotation between both rotating bodies, even when the cam shaft undergoes positive and negative torque fluctuations due to a drive of the suction valve or exhaust valve, it is possible to prevent the generation of a hammering sound between the crank shaft side rotating body and the cam shaft side rotating body.

When changing the phase of the cam shaft side rotating body relative to the crank shaft side rotating body, the lock member is withdrawn from the housing by applying to the lock member an operating oil pressure that rotates the cam shaft side rotating body relative to the crank shaft side rotating body. As a result, relative rotation between the crank shaft side rotating body and the cam shaft side rotating body becomes possible.

Since the valve timing control apparatus which receives a drive force of the crank shaft by way of the timing gear or chain sprocket can be accommodated within an oil lubrication space of the engine, a back pressure chamber of the lock member opens to the oil lubrication space of the engine through a communication passage provided in the timing gear so that the lock member can be easily moved in its constraining position. Also, the operating oil discharged from the back pressure is returned to the oil lubrication space.

However, since the valve timing control apparatus receiving the drive force of the crank shaft by way of a timing pulley is disposed outside the oil lubrication space, the operating oil is discharged to outside the oil lubrication space when the operating oil in the back pressure chamber is discharged to outside the apparatus through a communication passage provided in the timing pulley. As a result, the operating oil decreases. Further, the operating oil discharged from the back pressure chamber is dispensed on a timing belt. As a result, the oil causes the timing belt to slip at its meshed portion between itself and the timing pulley and crank shaft. Further, the oil causes the timing belt to deteriorate.

Also, the back pressure chamber of the lock member remains open to the oil lubrication space regardless of the position of the relative rotation between the crank shaft side rotating body and the cam shaft side rotating body. Because the movement of the lock member is not regulated, there is the likelihood that the lock member will collide with other members to thereby generate undesirable hammering sounds.

Also, even when the crank shaft side rotating body and the cam shaft side rotating body rotate relative to one another, if the lock member is at all times in contact with an oil pressure chamber to supply the operating oil to the lock member in a direction of releasing the constraint, there is the likelihood that the lock member vibrates due to the pulsation of the operating oil supplied from an oil pressure source. As a result, the lock member collides with other members to thereby generate undesirable hammering sounds.

SUMMARY OF THE INVENTION

An object of the present invention is to provide a valve timing control apparatus which regulates the movement of an abutting portion in a constraint-free state, prevents the collision of the abutting portion with other members, and thereby suppresses the generation of undesirable hammering sounds.

In the valve timing control apparatus according to one aspect of the present invention, there are provided an abutting portion and an abutted portion, which constrain the relative rotation of the driving side rotating arrangement and the driven side rotating arrangement. A back pressure chamber of the abutting portion communicates with an oil lubrication space through an oil passage provided in at least one of the rotating arrangements and sealed by a seal member. Therefore, the operating oil discharged from the back pressure chamber is returned to an oil lubrication space. Accordingly, it is possible to prevent a decrease in the volume of operating oil. Further, since the operating oil discharged from the back pressure chamber is not dispensed on the outer periphery of the valve timing control apparatus, for example in a case where the drive force of a crank shaft is received by a timing pulley, the operating oil is not dispensed on a timing belt. As a result, the timing belt is prevented from slipping at its meshed portion between itself and the crank shaft and the timing pulley. Also the deterioration of the timing belt is prevented.

Further, when the abutting portion and the abutted portion are in a constraint-free state, a valve mechanism closes the back pressure chamber. Therefore, the back pressure chamber becomes a damper chamber, whereby the movement of the abutting portion is regulated in a constraint-free state. This suppresses the collision of the abutting portion with other members and thereby suppresses the generation of undesirable hammering sounds.

In the valve timing control apparatus according to a second aspect of the present invention, the back pressure chamber communicates with an oil lubrication space through a sliding surface between the driving side rotating arrangement and the driven side rotating arrangement at a position of constraint between the abutting portion and the abutted portion. Therefore, when the driven side rotating arrangement rotates relative to the driving side rotating arrangement, the back pressure chamber is reliably closed.

In the valve timing control apparatus according to a third aspect of the present invention, when the driven side rotating arrangement rotates relative to the driving side rotating arrangement, from a constrained position between the abutting portion and the abutted portion, in addition to the closure of the back pressure chamber, either the pressure receiving area of the abutting portion in contact with an oil pressure chamber applying a force in a constraint release direction decreases, or the abutting portion and the oil pressure chamber, are brought out of contact with each other. Accordingly, even when pulsation occurs in the operating oil supplied to the oil pressure chamber in contact with the abutting portion, it is possible to further suppress the vibration of the abutting portion. Accordingly, collision of the abutting portion with other members is suppressed, and the generation of undesirable hammering sounds is suppressed.

BRIEF DESCRIPTION OF THE DRAWINGS

Additional objects and advantages of the present invention will be more readily apparent from the following detailed description of preferred embodiments thereof when taken together with the accompanying drawings in which:

FIG. 9 is a cross-sectional side view of a valve timing control apparatus according to a fifth embodiment of the present invention; and FIG. 10 is a longitudinal sectional view illustrating a stopper piston and its surrounding portions of FIG. 9.

DETAILED DESCRIPTION OF THE PREFERRED EMBODIMENTS

Figure 1:
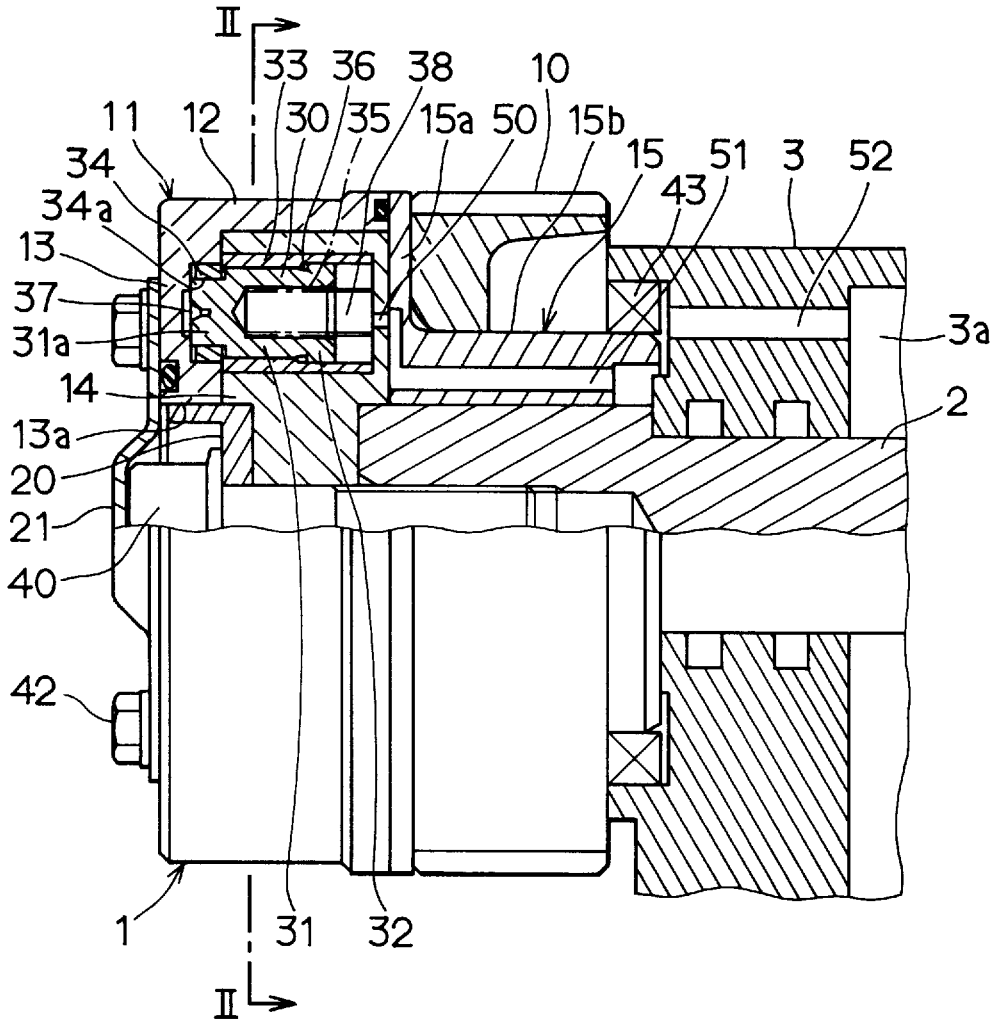
FIG. 1 is a side cross-sectional view of a valve timing control apparatus according to a first embodiment of the present invention.

A plurality of embodiments of the present invention will now be explained with reference to the drawings.

(First Embodiment)

A valve timing control apparatus for an internal combustion engine according to a first embodiment of the present invention is illustrated in FIGS. 1–5. A valve timing control apparatus 1 according to the first embodiment is of an oil pressure controllable type and is intended to control the valve timing of an intake or suction valve. The valve timing control apparatus 1 is disposed outside an oil lubrication space 3*a* formed inside an engine cover 3 serving as a partition wall.

A timing pulley 10 is connected to a crank shaft serving as a drive shaft of the engine. A crank shaft drive force is transmitted to the timing pulley, and the timing pulley 10 rotates in synchronism with the crank shaft. A rear member 15 is composed of a plate portion 15*a* and a bearing portion 15*b*, and the timing pulley 10 is fitted onto an outer periphery of the bearing portion 15*b*. A joint portion between the bearing portion 15*b* of the rear member 15 and the engine cover 3 is sealed by an oil seal 43. The driving pulley transmits a drive force to a cam shaft 2, serving as a driven shaft, to thereby open and close a suction valve (not illustrated). The cam shaft 2 can rotate relative to the timing pulley 10 with a prescribed phase difference being set therebetween. The timing pulley 10 and the cam shaft 2 rotate in a clockwise direction when viewed from the left side of FIG. 1. This rotation direction is hereinafter referred to as "the advance direction".

A shoe housing 11 is composed of a circumferential wall 12 and a front portion 13. Both end surfaces in the axial direction of a vane rotor 14 are covered by a plate portion 15*a* of the rear member 15 and the front portion 13 of the shoe housing 11. The timing pulley 10, shoe housing 11 and rear member 15 constitute a driving side rotating arrangement and are fixed by bolts illustrated in FIG. 2 so as to have the same axis.

The shoe housing 11 has shoes 11*a*, 11*b*, 11*c* which are trapezoidally formed in such a way as to be circumferentially substantially equi-angularly spaced apart from each other. At three circumferential gaps between the shoes 11*a*, 11*b*, 11*c* there are formed sectorial space portions 60 serving as accommodation chambers for accommodating vanes 14*a*, 14*b*, 14*c* serving as vane members, respectively. Inner-peripheral surfaces of the shoes 11*a*, 11*b*, 11*c* are each formed in the shape of a circular arc in section.

The vane rotor 14 includes the vanes 14*a*, 14*b*, 14*c* substantially equi-angularly in the circumferential direction. The arrow marks in FIG. 2 that indicate the lag direction and advance direction represent the direction in which the vane rotor 14 is lagged, and the direction in which the vane rotor 14 is advanced, relative to the shoe housing 11. As illustrated in FIG. 1, the vane rotor 14 and a bush 20 are integrally fixed to the cam shaft 2 by means of a bolt 40, thereby constituting a driven side rotating arrangement. A cover 21 is mounted on the front portion 13 by means of a bolt 42 to thereby prevent leakage of an operating oil from, for example, a slide portion between the bush 20 and the front portion 13, from the valve timing control apparatus 1.

Since the cam shaft 2 and the bush 20 are relatively rotatably fitted into the bearing portion 15*b* of the rear member 15 and an inner-circumferential wall 13*a* of the front portion 13 respectively, the cam shaft 2 and the vane rotor 14 are coaxially rotatable relative to the timing pulley 10 and the shoe housing 11.

Figure 2:
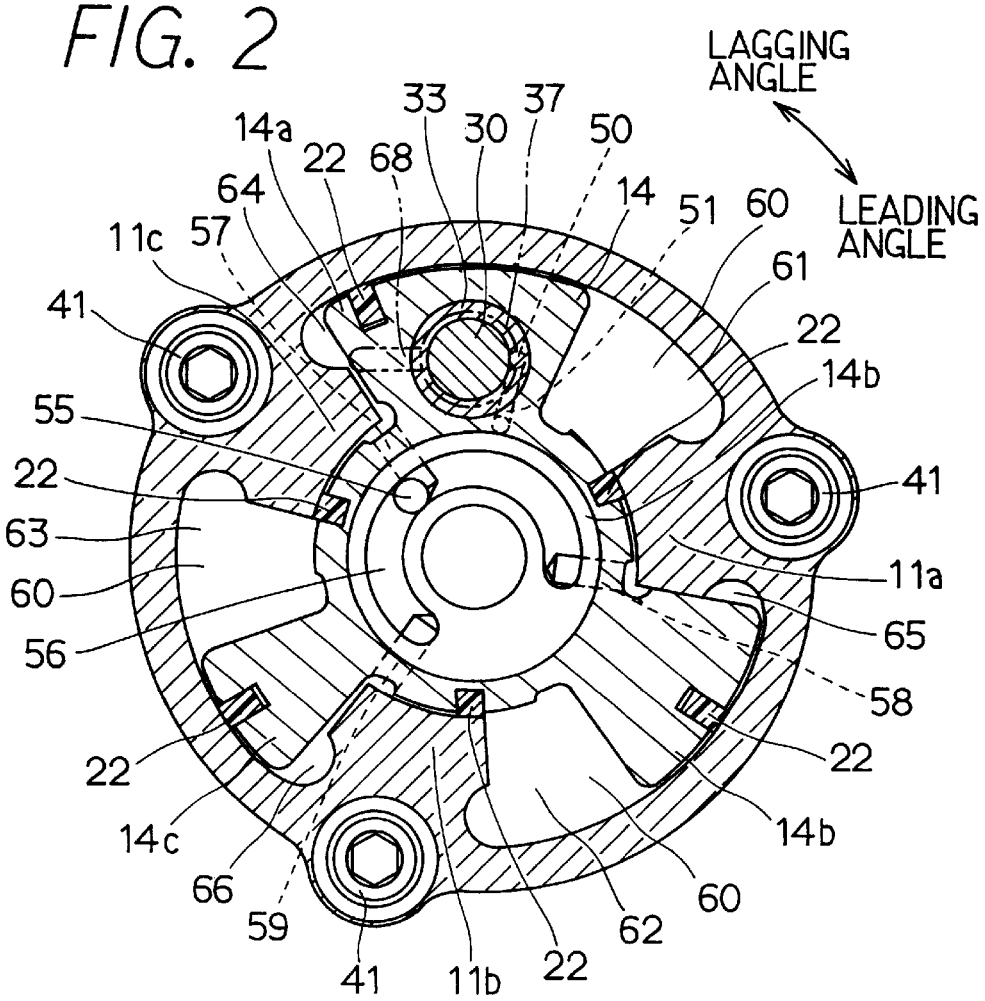
FIG. 2 is a sectional view taken along a line II—II of FIG. 1.

As illustrated in FIG. 2, a lag oil pressure chamber 61 is formed between the shoe 11*a* and the vane 14*a*, a lag oil pressure chamber 62 is formed between the shoe 11*b* and the vane 14*b*, and a lag oil pressure chamber 63 is formed between the shoe 11*c* and the vane 14*c*. Also, an advance oil pressure chamber 64 is formed between the shoe 11*c* and the vane 14*a*, an advance oil pressure chamber 65 is formed between the shoe 11*a* and the vane 14*b*, and an advance oil pressure chamber 66 is formed between the shoe 11*b* and the vane 14*c*. By switching a switching valve (not illustrated), the operating oil can be supplied to one of the lag oil pressure chambers and the corresponding advance oil pressure chambers, and the other chambers thereof can be opened to the atmosphere.

Through a switching valve (not illustrated), the lag oil pressure chambers 61, 62, 63 communicate with oil passages (not illustrated), which in turn communicate with an oil pressure pump that serves as an oil pressure source or a drain. Also, an oil pressure chamber 36 communicates with the lag oil pressure chamber 61 through an oil passage 67.

An oil passage illustrated in FIG. 2 communicates with a circular-arc shaped oil passage 56 formed in a boss portion 14*d* of the vane rotor 14. On the other hand, an oil passage 56 communicates with the advance oil pressure chambers 64, 65, 66 through oil passages 57, 58, 59. Also, an oil pressure chamber 37 illustrated in FIG. 3 communicates with the advance oil pressure chamber 64 through an oil passage 68.

As illustrated in FIG. 2, seal members 22 are fitted into an outer-peripheral wall of the vane rotor 14. A very small clearance is provided between the outer-peripheral wall of the vane rotor 14 and an inner-peripheral wall of the shoe housing 11. The operating oil is prevented by the seal members 22 from being leaked between the oil pressure chambers through this clearance. The seal members 22 are urged by plate springs toward the inner-peripheral wall of the shoe housing 11.

As illustrated in FIG. 1, a guide ring 33 is inserted into the vane 14*a*, and is retained by an inner wall of the vane 14*a*. Into this guide ring 33, a reciprocating stopper piston 30, which serves as an abutting portion, is inserted. The stopper piston 30 is composed of a bottomed circular-cylindrical portion 31 and an annular flange portion 32 provided on an opening end of the circular-cylindrical portion 31. The stopper piston 30 is slidably accommodated within the guide ring 33 in the axial direction of the cam shaft 2, and is urged by a spring 35 toward a side of the front portion 13. A fitting ring 34 having a taper hole 34*a* serving as an abutted portion is inserted into, and retained by, a fitting hole formed in the front portion 13, whereby the stopper piston 30 can be fitted into the taper hole 34*a*. In a state where the stopper piston 30 is fitted in the taper hole 34*a*, the rotation of the vane rotor 14 relative to the shoe housing 11 is constrained.

Figure 3:
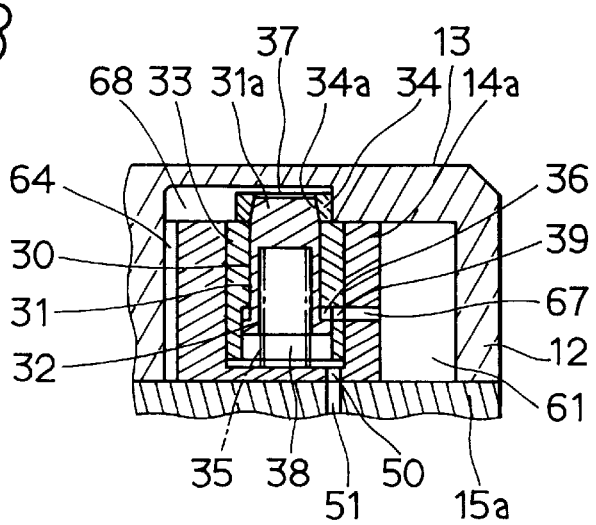
FIG. 3 is a longitudinal sectional view illustrating a stopper piston and its surrounding portions of the first embodiment.

As illustrated in FIG. 3, the oil pressure chamber 36 formed between the flange portion 32 and the guide ring 33 is communicated with the lag oil pressure chamber 61 through a communication hole 39 formed in the guide ring 33 and the oil passage 67 formed in the vane 14*a*. An oil pressure chamber 37 formed on a forward end portion side 31a of the circular-cylindrical portion 31 is communicated with the advance oil pressure chamber 64 through the oil passage 68. The force received by the stopper piston 30 from the operating oil of the oil pressure chamber 36 and the oil pressure chamber 37 causes the stopper piston 30 to be withdrawn from the taper hole 34*a*. When the operating oil having a prescribed, or higher than prescribed, pressure is supplied to the lag oil pressure chamber 61 or advance oil pressure chamber 64, the stopper piston 30 is withdrawn from the taper hole 34*a* against the biasing force of the spring 35 by the oil pressure.

The position of the stopper piston 30 and the position of the taper hole 34*a* are set so that, when the vane rotor 14 is located at its most lagged position, relative to the shoe housing 11, as illustrated in FIGS. 2 and 3, namely when the cam shaft 2 is located at its most lagged position relative to the crank shaft, the stopper piston 30 is urged into the taper hole 34*a* by the bias force of the spring 35. When the vane rotor 14 is rotated relative to the shoe housing 11 from the most lagged position toward the advanced position, the stopper piston 30 is not urged into the taper hole 34*a* as the position of the stopper piston 30 is displaced from the position of the taper hole 34*a*.

A back pressure chamber 38 is defined on a side of the stopper piston 30 opposite the pressure-receiving side thereof, with respect to the oil pressure chambers 36, 37, by inner-peripheral walls of the vane 14*a*, guide ring 33 and stopper piston 30. The back pressure chamber 38 is cut off from the oil pressure chamber 36 by a slide portion between the flange portion 32 and the inner-peripheral wall of the guide ring 33. The chamber 38 is also cut off from the oil pressure chamber 37 by a slide portion between the circular-cylindrical portion 31 and the inner-peripheral wall of the guide ring 33. Further, the back pressure chamber 38 communicates with a communication passage 50 formed on a rear member 15 side of the vane 14*a*.

As illustrated in FIG. 1, a communication passage 51 is formed as to pass through the timing pulley 10 in the axial direction thereof. Only when the vane rotor 14 is located at its most lagged position relative to the shoe housing 11, namely, only when the stopper piston 30 and the taper hole 34*a* are located at a constraining position at which the former is fitted into the latter, does the communication passage 51 communicate with the back pressure chamber 38 through the communication passage 50 formed in the vane 14*a*. The communication passage 50 and the communication passage 51 communicate with each other through a sliding surface between the vane 14*a* and the plate portion 15*a* that serve as a valve mechanism.

A communication passage 52 communicates with an oil lubrication space 3*a* formed in the engine cover 3. The communication passages 51, 52 at all times communicate with each other regardless of the rotational position of the rear member 15, because the end of one of these communication passages 51, 52 is annularly formed at a connecting portion between the bearing portion 15*b* and the engine cover 3. The communication passages 51, 52 are partially sealed by an oil seal 43. When the stopper piston 30 is fitted into the taper hole 34*a*, since the back pressure chamber 38 opens to the oil lubrication space 3*a* through the communication passages 50, 51, 52, the movement of the stopper piston 30 is not hindered. Further, as the stopper piston 30 is moved, the operating oil within the back pressure chamber 38 is discharged into the oil lubrication space 3*a* through the communication passages 50, 51, 52. At an end surface of the plate portion 15*a*, the communication passage 51 is only formed as a radially extending slender groove. Therefore, when the vane rotor 14 is moved from the most lagged position toward the advanced side, the communication passage 50 is brought out of coincidence with this radial groove, and is closed by the end surface of the plate portion 15*a*. For this reason, communication between the communication passage 50 and the communication passage 51 is rendered ineffective, with the result that the back pressure chamber 38 is closed.

Next, operation of the valve timing control apparatus 1 will be explained.

At the time of start of the engine, when the operating oil is not yet introduced from the oil pressure pump into the oil pressure chambers 36, 37, the vane rotor 14 is located at its most lagged position illustrated in FIGS. 2 and 3 relative to the shoe housing 11 with rotation of the crank shaft. The forward end portion 31*a* of the stopper piston 30 is urged in the taper hole 34*a* by the biasing force of the spring 35. As a result, the vane rotor 14 and the shoe housing 11 are firmly constrained. Accordingly, even when, at the time of driving, the suction valve the cam shaft 2 undergo positive/negative torque fluctuations, there is no possibility that the vane rotor 14 will start to rotate and vibrate relative to the shoe housing 11, since the movement of the vane rotor 14 toward the lagged or advanced side relative to the shoe housing 11 is regulated. Thus, the vane rotor 14 is prevented from colliding with the shoe housing 11 and thereby generating hammering sounds.

After the start of the engine, the operating oil is supplied to each lag oil pressure chamber. The operating oil is supplied to the lag oil pressure chambers 61, 62, 63 through the oil passage (not illustrated). Further, the operating oil is supplied from the lag oil pressure chamber 61 to the oil pressure chamber 36 through the oil passage 67. When the oil pressure of the operating oil supplied to the lag oil pressure chamber 61 reaches a predetermined level or higher, the stopper piston 30 is withdrawn from the taper hole 34*a* against the urging force of the spring 35 owing to the force received from the oil pressure chamber 36 by the pressure-receiving surface of the stopper piston 30. As a result, the vane rotor 14 is released from the constrained state jointly with the shoe housing 11.

Even when the stopper piston 30 has been withdrawn from the taper hole 34*a*, the vane rotor 14 receives the oil pressure from the lag oil pressure chambers 61, 62, 63 in the direction in which the vane rotor 14 is lagged. The average of the positive/negative torque fluctuations experienced by the cam shaft 2 urges the vane rotor 14 toward the lagged side relative to the shoe housing 11. Therefore, the vane rotor 14 is still retained, relative to the shoe housing 11, at its most lagged position, as illustrated in FIGS. 2 and 3, namely at one circumferential end portion side of the sectorial space portion 60. Therefore, generation of hammering sounds between the vane rotor 14 and the shoe housing 11 is suppressed.

Next, when switching the switching valve and thereby releasing the lag oil pressure chambers 61, 62, 63 from the states illustrated in FIGS. 1, 2 and 3 to the atmosphere, and thereby supplying the operating oil to the advance oil pressure chambers 64, 65, 66, the operating oil is supplied from the advance oil pressure chamber 64 to the oil pressure chamber 37. The vane rotor 14 is thus moved relative to the shoe housing 11 in a clockwise direction as viewed from the left side of FIG. 1, i.e. in the advance direction, as the stopper piston 30 has been withdrawn from the taper hole 34*a*. In this way, through control of the oil pressure of each oil pressure chamber, it is possible to control the relative phase difference of the vane rotor 14 relative to the shoe housing, i.e. the relative phase difference of the cam shaft 2 relative to the crank shaft.

Figure 4:
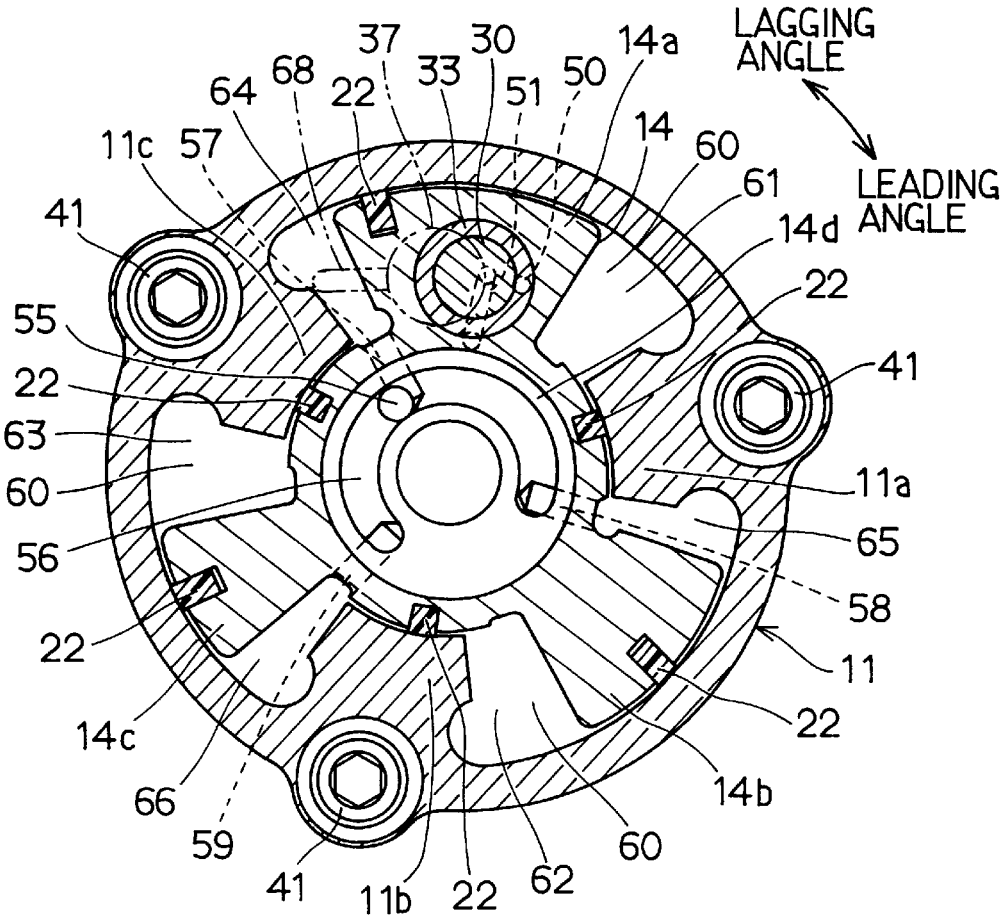
FIG. 4 is a cross-sectional view illustrating the valve timing control apparatus wherein the vane rotor is rotated to an advanced side.
Figure 5:
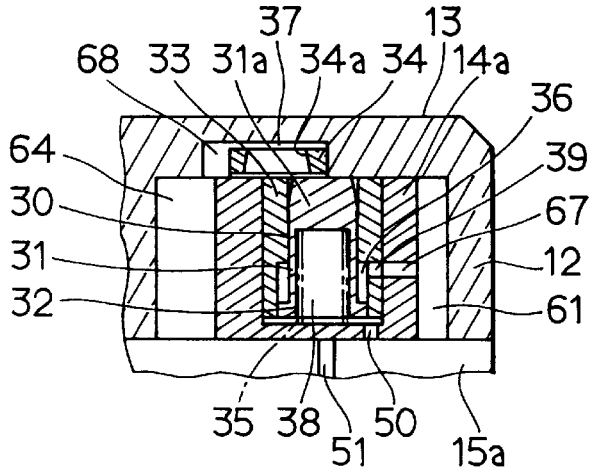
FIG. 5 is a longitudinal sectional view illustrating a stopper piston and its surrounding portions of FIG. 4.

As illustrated in FIGS. 4 and 5, when the vane rotor 14 rotates relative to the shoe housing 11 from its most lagged position toward the advanced side, the stopper piston 30 ceases to be fitted into the taper hole 34*a*, as the respective circumferential positions of the stopper piston 30 and the taper hole 34*a* are displaced from each other. Further, the force received from the operating oil of the oil pressure chamber 37 by the stopper piston 30 is small, as the pressure-receiving area of the forward end portion 31*a* of the stopper piston 30 in contact with the oil pressure chamber 37 decreases compared to this pressure-receiving area that prevails when the vane rotor 14 is situated at the most lagged position. Accordingly, even when oil pressure fluctuation, i.e. pulsation, occurs in the operating oil supplied from the oil pressure pump (not illustrated) to the oil pressure chamber 37, the vibration of the stopper piston 30 within the guide ring 33 can be suppressed. Accordingly, the collision of the stopper piston 30 with other members, such as the front portion 13 and the plate portion 15*a*, is suppressed. As a result, the generation of hammering sounds is suppressed. When the vane rotor 14 further rotates relative to the shoe housing 11 toward the advanced side, the oil pressure chamber 37 is closed by the vane 14*a*, with the result that the forward end portion 31*a* is brought out of contact with the oil pressure chamber 37. When the forward end portion 31*a* is brought out of contact with the oil pressure chamber 37, the stopper piston 30 ceases to receive the effect of the pulsation of the operating oil from the oil pressure chamber 37. Accordingly, as the vibration of the stopper piston 30 is prevented, the collision of the stopper piston 30 with other members, such as the front portion 13 and the plate portion 15*a*, is prevented. As a result, the generation of hammering sounds is prevented.

Also, when the vane rotor 14 rotates relative to the shoe housing 11 from the most lagged position toward the advanced side, communication between the communication passages 50, 51 is cut off by the sliding surface between the vane 14*a* and the plate portion 15*a* of the rear member 15. That is, because the back pressure chamber 38 is closed and substantially sealed, even when the forward end portion 31*a* of the stopper piston 30 is still in contact with the oil pressure chamber 37 as illustrated in FIGS. 4 and 5, the stopper piston 30 is unlikely to receive the effect of the pulsation of the operating oil supplied to the oil pressure chamber 37. Accordingly, the vibration of the stopper piston 30 within the guide ring 33 is suppressed. Also, collision of the stopper piston 30 with other members, such as the front portion 13 and the plate portion 15*a*, is suppressed, with the result that the generation of hammering sounds is suppressed.

Also, because in the first embodiment the communication passage 51 is formed through the rear member 15, foreign substances within the communication passage 51 are unlikely to enter into the slide portion between the bearing portion 15*b* and the cam shaft 2.

(Second Embodiment)

Figure 6:
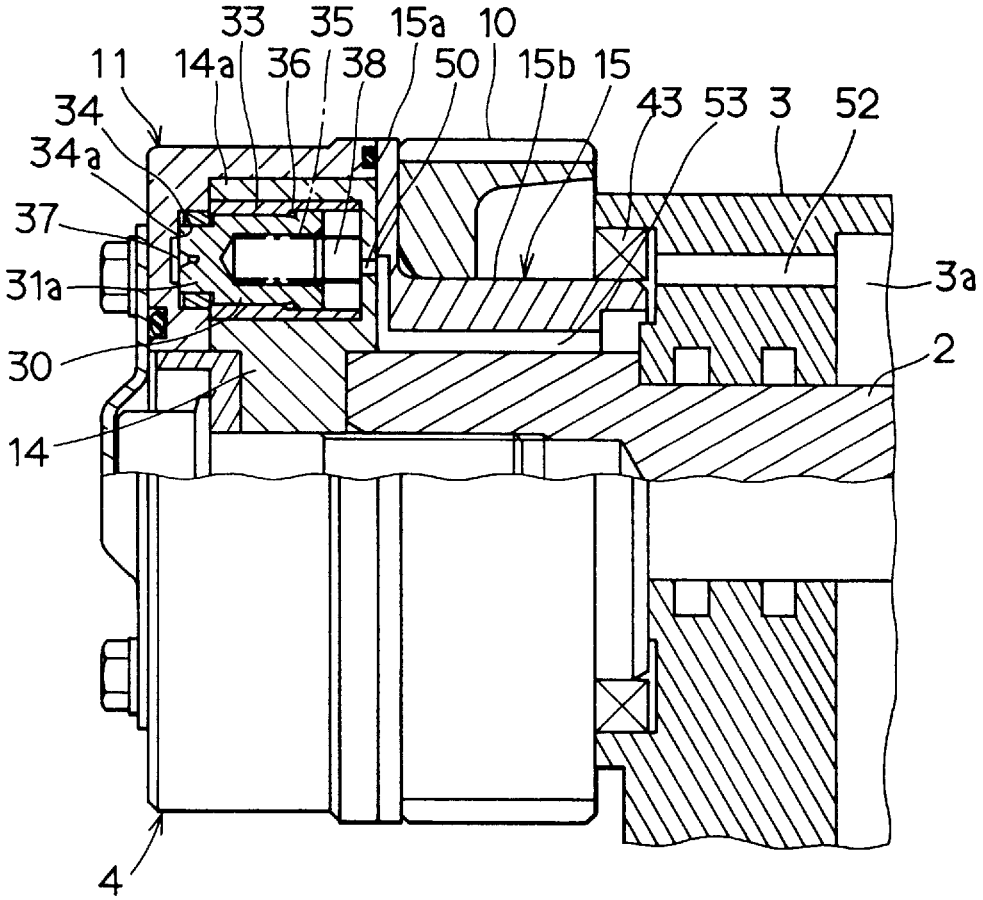
FIG. 6 is a cross-sectional side view of a valve timing control apparatus according to a second embodiment of the present invention.

A second embodiment of the present invention is illustrated in FIG. 6. In a valve timing control apparatus 4 of the second embodiment, the constituent portions that are substantially the same as those in the first embodiment are denoted by like reference symbols.

Part of a communication passage 53 is formed in the inner-peripheral wall of the bearing portion 15*b* in the shape of a groove. The communication passage 53 communicates with the communication passage 52 and, when the vane rotor 14 is located at its most lagged position relative to the shoe housing 11, namely at the constrained position where the stopper piston 30 is fitted in the taper hole 34*a*, communicates with the back pressure chamber 38 through the communication passage 50.

Still referring to FIG. 6, when the vane rotor 14 rotates relative to the shoe housing 11 from its most lagged position toward the advanced side, the back pressure chamber 38 is closed. Thus, either the pressure-receiving area of the forward end portion 31*a* in contact with the oil pressure chamber 37 decreases, or the forward end portion 31*a* is brought out of contact with the oil pressure chamber. Accordingly, even when pulsation occurs in the operating oil supplied to the oil pressure chamber 37, the collision of the stopper piston 30 with other members, such as the front portion 13 and the plate portion 15*a*, is suppressed. As a result, the generation of hammering sounds is suppressed.

(Third Embodiment)

Figure 7:
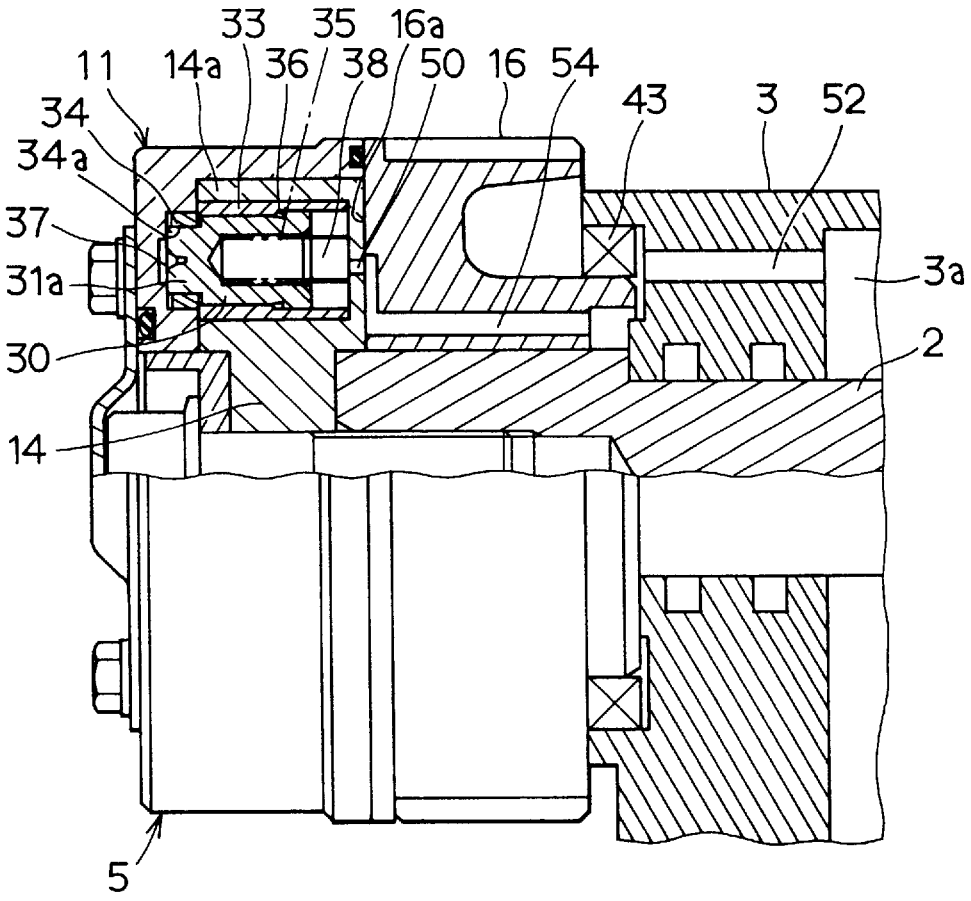
FIG. 7 is a cross-sectional side view of a valve timing control apparatus according to a third embodiment of the present invention.

A third embodiment of the present invention is illustrated in FIG. 7. The constituent portions that are substantially the same as those in the first embodiment are denoted by like reference symbols.

A timing pulley 16 is connected to the crank shaft by means of a timing belt (not illustrated), and is fitted onto the outer periphery of the cam shaft 2. That is, the timing pulley 16 concurrently serves both as the timing pulley 10 and rear member 15 of the first embodiment. A communication passage 54 is formed through the timing pulley 16 in the axial direction thereof. The communication passage 54 communicates with the communication passage 52 and, when the vane rotor 14 is located at its most lagged position relative to the shoe housing 11, namely at the constrained position where the stopper piston 30 is fitted in the taper hole 34*a*, communicates with the back pressure chamber 38 through the communication passage 50. At the end surface 16*a* on the vane rotor side 14 of the timing pulley 16, the communication passage 54 is only formed as a radially extending slender groove. Therefore, when the vane rotor 14 rotates relative to the shoe housing 11 from the most lagged position toward the advanced side, the communication passage 50 is brought out of coincidence with the radial groove, and is thereby closed by the end surface 16*a* of the timing pulley 16. For this reason, communication between the communication passage 50 and the communication passage 54 is rendered ineffective, with the result that the back pressure chamber 38 is closed.

Also, in the third embodiment, when the vane rotor 14 rotates relative to the shoe housing 11 from its most lagged position toward the advanced side, the back pressure chamber 38 is closed, and either the pressure-receiving area of the forward end portion 31*a* in contact with the oil pressure chamber 37 decreases, or the forward end portion 31*a* is brought out of contact with the oil pressure chamber 37. Accordingly, even when pulsation occurs in the operating oil supplied to the oil pressure chamber 37, the collision of the stopper piston 30 with other members, such as the front portion 13 and the timing pulley 16 is suppressed. As a result, the generation of hammering sounds is suppressed.

In the third embodiment, since the timing pulley 16 is fitted directly on the outer periphery of the cam shaft 2, the number of the parts employed decreases, and the number of the assembling steps decreases. Also, since the communication passage 54 is formed through the timing pulley 16, foreign substances within the communication passage 54 are unlikely to enter into the slide portion between the timing pulley 16 and the cam shaft 2.

(Fourth Embodiment)

Figure 8:
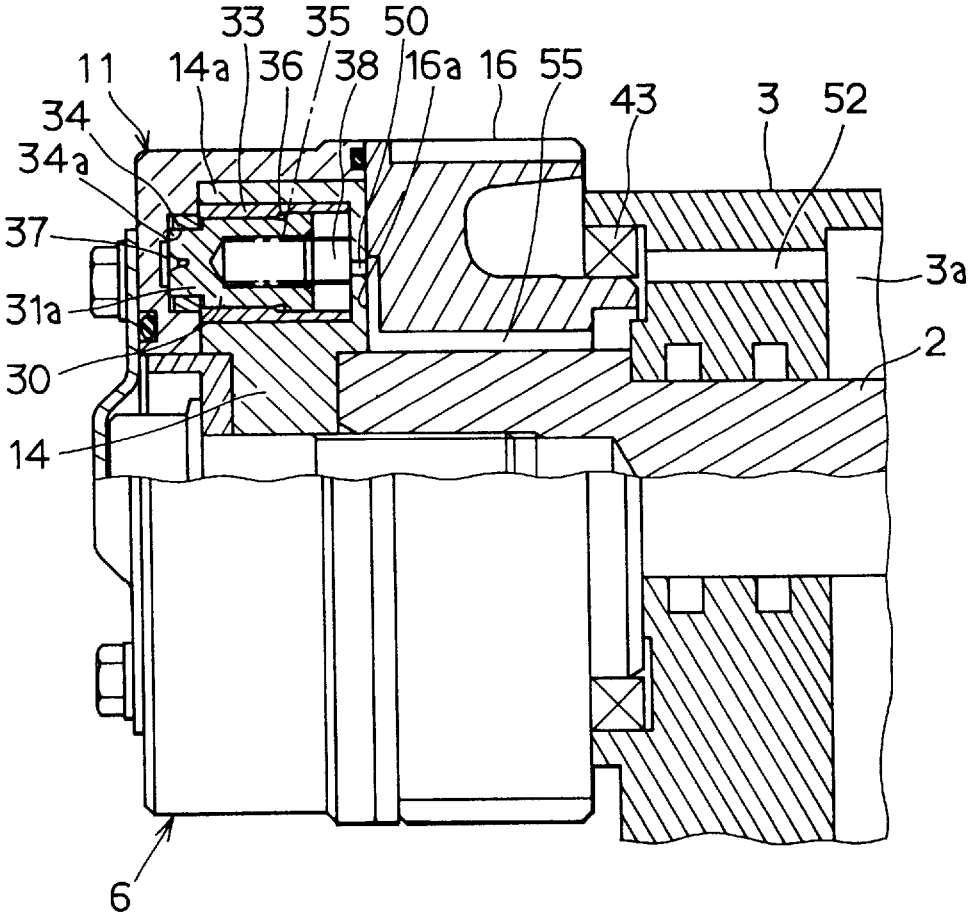
FIG. 8 is a cross-sectional side view of a valve timing control apparatus according to a fourth embodiment of the present invention.

A fourth embodiment of the present invention is illustrated in FIG. 8. The constituent portions that are substantially the same as those in the third embodiment are denoted by like reference symbols.

Part of a communication passage 55 is formed in the inner-peripheral wall of the timing pulley 16 in the shape of a groove. The communication passage 55 communicates with the communication passage 52 and, when the vane rotor 14 is located at its most lagged position relative to the shoe housing 11, namely, when the stopper piston 30 is situated at the constraining position where the stopper piston 30 is fitted in the taper hole 34*a*, communicates with the back pressure chamber 38 through the communication passage 50.

In the fourth embodiment, when the vane rotor 14 rotates relative to the shoe housing 11 from its most lagged position toward the advanced side, the back pressure chamber 38 is closed because the communication passage 50 is closed by the end surface 16*a* of the timing pulley 16. Further, either the pressure-receiving area of the forward end portion 31*a* in contact with the oil pressure chamber 37 decreases, or the forward end portion 31*a* is brought into non-contact with the oil pressure chamber 37. Accordingly, even when pulsation occurs in the operating oil supplied to the oil pressure chamber 37, the collision of the stopper piston 30 with other members, such as the front portion 13 and the timing pulley 16, is suppressed, with the result that the generation of hammering sounds is suppressed.

Also, since the timing pulley 16 is fitted directly on the outer periphery of the cam shaft 2, the number of parts employed decreases, and the number of assembly steps decreases.

In the above-explained first to fourth embodiments, the oil pressure chamber 36 and the oil pressure chamber 37 are provided so as to permit the stopper piston 30 to be withdrawn from the taper hole 34*a* upon application of either one of the lag oil pressure and the advance oil pressure. However, the circular-cylindrical portion of the stopper piston may have the same diameter to permit the stopper piston to be withdrawn from the taper hole upon reception of only the advance oil pressure by the forward end portion of the circular-cylindrical portion.

(Fifth Embodiment)

A fifth embodiment of the present invention is illustrated in FIGS. 9 and 10. The constituent portions substantially the same as those in the first embodiment are denoted by like reference symbols. A valve timing control apparatus 7 of the fifth embodiment is directed to controlling the valve timing of the exhaust valve.

An oil passage 75 communicates with a circular-arc shaped oil passage 76 formed in the boss portion 14*d* of the vane rotor 14. The oil passage 76 communicates with the lag oil pressure chambers 61, 62, 63 through oil passages 77, 78, 79. Also, the oil pressure chamber 37 communicates with the lag oil pressure chamber 61 through an oil passage 71. The oil pressure chamber 36 communicates with the advance oil pressure chamber 64 through a communication passage 39 and an oil passage 70.

As illustrated in FIGS. 9 and 10, when the vane rotor 14 is located at its most advanced position relative to the shoe housing 11, the stopper piston 30 can be fitted into the taper hole 34*a*. When the stopper piston 30 is fitted into the taper hole 34*a*, the rotation of the vane rotor 14 relative to the shoe housing 11 is constrained.

When the vane rotor 14 rotates relative to the shoe housing 11 from its most advanced position toward the lagged side, the stopper piston 30 ceases to be fitted into the taper hole 34*a* as the respective circumferential positions of the stopper piston 30 and the taper hole 34*a* are displaced from each other. Further, when the vane rotor 14 further rotates relative to the shoe housing 37 from the most advanced position toward the lagged side, the pressure-receiving area of the forward end portion 31*a* of the stopper piston 30 in contact with the oil pressure chamber 37 decreases compared to the pressure-receiving area that prevails when the vane rotor 14 is situated at the most advanced position. As a result, the force received from the operating oil of the oil pressure chamber 37 by the stopper piston 30 is small. Accordingly, even when oil pressure fluctuation, i.e. pulsation, occurs in the operating oil supplied from the oil pressure pump (not illustrated) to the oil pressure chamber 37, the vibration of the stopper piston 30 within the guide ring 33 can be suppressed. Accordingly, the collision of the stopper piston 30 with other members, such as the front portion 13 and the plate portion 15*a*, is suppressed. As a result, the generation of hammering sounds is suppressed. When the vane rotor 14 further rotates relative to the shoe housing 11 toward the lagged side, the oil pressure chamber 37 is closed by the vane 14*a*, and the forward end portion 31*a* is brought out of contact with the oil pressure chamber 37. As a result, the stopper piston 30 ceases to receive the effect of the pulsation of the operating oil of the oil pressure chamber 37.

Also, when the vane rotor 14 rotates relative to the shoe housing 11 from the most advanced position toward the lagged side, communication between the communication passages 50, 51 is cut off by the sliding surface between the vane 14*a* and the plate portion 15*a* of the rear member 15. That is, since the back pressure chamber 38 is closed and substantially sealed, even when the forward end portion 31*a* of the stopper piston 30 is in contact with the oil pressure chamber 37, the stopper piston 30 is unlikely to receive the effect of the pulsation of the operating oil supplied to the oil pressure chamber 37. Accordingly, the vibration of the stopper piston 30 within the guide ring 33 is suppressed, and the collision of the stopper piston 30 with other members such as the front portion 13 and the plate portion 15*a* is suppressed. As a result, the generation of hammering sounds is suppressed.

In the fifth embodiment, the oil pressure chamber 36 and the oil pressure chamber 37 are provided to permit the stopper piston 30 to be withdrawn from the taper hole 34*a* upon application of either one of the lag oil pressure and the advance oil pressure. However, the circular-cylindrical portion of the stopper piston may be made to have the same diameter to permit the stopper piston to be withdrawn from the taper hole upon reception of only the lag oil pressure by the forward end portion of the circular-cylindrical portion.

In the above-explained plurality of embodiments of the present invention, when the valve timing control apparatus is for use in the suction valve, the back pressure chamber 38 communicates with the oil lubrication space 3*a* within the engine through the communication passages at the time when the vane rotor 14 is located at its most lagged position relative to the shoe housing 11. When the valve timing control apparatus is for use in the exhaust valve, this back pressure chamber 38 communicates therewith at the time when the vane rotor 14 is located at its most advanced position relative to the shoe housing 11. Accordingly, when the vane rotor 14 is located at its most lagged or advanced position, no obstacle exists with respect to the movement of the stopper piston 30. Further, as the stopper piston 30 is moved, the operating oil discharged from the back pressure chamber 38 is returned to the oil lubrication space without being dispensed on the outer periphery of the valve timing control apparatus. Accordingly, the decrease in amount of the operating oil is prevented. Further, since the operating oil is not dispensed on the timing belt, timing belt slippage is prevented at the meshed portion between the belt and the crank shaft or timing pulley.

In addition, each valve timing control apparatus which has been illustrated in the above-described plurality of embodiments is constructed in such a way that the operating oil is leaked only from the end surface on the engine side of the rear member 15 or timing pulley 16. For this reason, it is important that the communication passage from the back pressure chamber 38 be made open to the end surface on the engine side of this rear member 15 or timing pulley 16. By adopting such a construction, a seal can be made, using only the oil seal 43 alone, between the valve timing control apparatus that rotates and the engine cover 3 that is stationary. Further, by using a construction such as that illustrated in FIG. 1 wherein the communication passage 52 on the engine cover 3 side is provided only at the highest position, it is possible to control the flow of the operating oil that flows out into the oil lubrication space 3*a*.

This sealed structure of the valve timing control apparatus can be realized by adopting the rear member 15, integrally equipped with the plate portion 15*a*, or the timing pulley 16, concurrently serving both as the timing pulley 10 and the rear member 15, and the shoe housing 11 having the circumferential wall 12 and the front portion 13 integrated therewith, without providing a number of sealed portions. Each of the plurality of embodiments can be realized using the rubber-made O-ring seals only at two positions, such that the O-ring seal is interposed between the shoe housing 11 and the rear member 15 or timing pulley 16 as illustrated in FIG. 1 or 7, and the opening on the forward end side of the shoe housing 11 is closed by the cover 21, with the O-ring being interposed therebetween. Furthermore, the seal between the rotating portion and the stationary portion is made by only the oil seal 43 alone. Such decrease in the number of the O-ring seals enhances the reliability of the apparatus.

Also, when the position of the vane rotor 14 is displaced relative to the shoe housing 11, whereby the stopper piston 30 and the taper hole 34*a* are brought into a non-constraining state, either the pressure-receiving area of the forward end portion 31*a* of the stopper piston 30 in contact with the oil pressure chamber 37 decreases compared to this pressure-receiving area that prevails when the stopper piston 30 and the taper hole 34*a* are in a constraining state, or the stopper piston 30 is brought into non-contact with the oil pressure chamber 37, and therefore the force received from the operating oil of the oil pressure chamber 37 by the stopper piston 30 is small. Accordingly, even when pulsation occurs in the operating oil supplied from the oil pressure pump (not illustrated) to the oil pressure chamber 37, the collision of the stopper piston 30 with other members, such as the front portion 13 and the plate portion 15*a* or timing pulley, is suppressed, with the result that the generation of hammering sounds is suppressed.

Also, when the position of the vane rotor 14 is displaced relative to the shoe housing 11 whereby the stopper piston 30 and the taper hole 34*a* are brought into a non-constraining state, communication between the communication passages 50, 51 is cut off by the sliding surface between the vane 14*a* and the rear member 15 or timing pulley 16. That is, since the back pressure chamber 38 is closed and substantially sealed, even when the forward end portion 31*a* of the stopper piston 30 is in contact with the oil pressure chamber 37, the stopper piston 30 is unlikely to vibrate even when pulsation occurs in the operating oil supplied to the hydraulic chamber 37. Accordingly, collision of the stopper piston 30 with other members such as the front portion 13 and the plate portion 15*a* or timing pulley 16 is suppressed, with the result that the generation of hammering sounds is suppressed.

Also, in the above-described plurality of embodiments, the stopper piston 30 may be moved in the axial direction of the vane rotor 14, and is fitted into the taper hole 34*a* disposed in the shoe housing 11. However, the stopper piston may also be fitted into the taper hole by being moved in the radial direction of the shoe housing. Also, the stopper piston may be accommodated in the shoe housing.

Also, in the above-described plurality of embodiments of the present invention, the drive force of the crank shaft serving as the drive shaft may be received by the timing pulley and the shoe housing 11 may be rotated integrally while the cam shaft 2 and the vane rotor 14 are rotated integrally with each other. However, the timing pulley and the vane rotor 14 may be rotated integrally with each other, and the cam shaft 2 and the shoe housing 11 may be rotated integrally with each other.

Further, in the above-described plurality of embodiments of the present invention, an explanation has been given of the valve timing control apparatus for controlling the valve timing of either one of the suction valve and the exhaust valve. However, it may be arranged that the valve timings of both the suction valve and the exhaust vale are controlled with the use of a single valve timing control apparatus.

What is claimed is:

1. A valve timing control apparatus for use in an internal combustion engine, the valve timing control apparatus being disposed outside an oil lubrication space of the internal combustion engine in a drive force transmission system for transmitting a drive force from a driving shaft of the internal combustion engine to a driven shaft for opening and closing at least one of an engine intake or suction valve and an exhaust valve, comprising:

a driving side rotating arrangement that rotates jointly with the driving shaft;

a driven side rotating arrangement that rotates jointly with the driven shaft and that is rotatable relative to the driving side rotating arrangement by an operating oil pressure;

a seal member disposed between a partition wall forming the oil lubrication space and at least one of the rotating arrangements; and constraining means having an abutting portion and an abutted portion that are provided respectively on the rotating arrangements, and that constrain relative rotation of the rotating arrangements by mutual abutment therebetween, the constraining means also having urging means for urging the abutting portion in a direction that constrains the rotating arrangements, the constraining means displacing the abutting portion in a direction that releases the constraint against the urging force of the urging means by operating oil pressure, wherein a back pressure chamber formed on a side of the abutting portion, opposite the side on which the abutting portion receives the pressure, communicates with the oil lubrication space through a communication passage provided in at least one of the rotating arrangements, and has a valve mechanism which closes off the back pressure chamber when the abutting portion and the abutted portion are in a constraint-free state.

2. The apparatus of claim 1, wherein the valve mechanism comprises a sliding surface between the driving side rotating arrangement and the driven side rotating arrangement; the back pressure chamber communicating with the oil lubrication space through the sliding surface when the abutting portion and the abutted portion are in a constraining position; the back pressure chamber being closed by the sliding surface when the driven side rotating arrangement is rotated from the constrained position relative to the driving side rotating arrangement.

3. The apparatus of claim 1, wherein when the driven side rotating arrangement is rotated from the constrained position relative to the driving side rotating arrangement, the pressure receiving area of the abutting portion that contacts an oil pressure chamber for applying the operating oil pressure in the direction of releasing the constraint decreases.

4. The apparatus of claim 1, wherein the abutting portion and the oil pressure chamber are brought out of contact with each other when the driven side rotating arrangement is rotated from the constrained position relative to the driving side rotating arrangement.

5. An engine valve timing apparatus, located outside of an oil lubrication space, that transmits a drive force from a driving shaft to a driven shaft to control engine valve operation, comprising:

a driving side rotating arrangement that rotates with the driving shaft, the driving side rotating arrangement including a housing having an abutment surface that defines an engagement bore;

a driven side rotating arrangement that rotates with the driven shaft;

a piston housed within a piston bearing defined in the driven side rotating arrangement, and that is biased toward the abutment surface of the driving side arrangement, the piston engaging the engagement bore when the driven side rotating arrangement is at a most lagging position to suppress collisions between the driving side rotating arrangement and the driven side rotating arrangement;

the driven side rotating arrangement further defining a plurality of oil pressure chambers that selectively communicate with the piston and the oil lubrication space, and that, when oil having a predetermined pressure is provided therein, cause the piston to withdraw from the engagement bore as the driving side rotating arrangement and the driven side rotating arrangement rotate from the most lagging position to an advanced position, to allow relative rotation between the driving side rotating arrangement and the driven side rotating arrangement, while suppressing collisions between the driven side rotating arrangement and the driving side rotating arrangement.

6. The apparatus of claim 5, wherein the driving side arrangement comprises:

a shoe housing that includes a plurality of shoes that extend radially inwardly therefrom;

a rear member including a plate connected to the shoe housing, and a bearing portion that extends from the rear member and that defines a communication passage that selectively allows oil to flow between the piston bearing and the oil lubrication space; and a pulley member that is fitted onto an outer periphery of the bearing portion that rotates in synchronism with the drive shaft.

7. The apparatus of claim 6, wherein the communication passage comprises a groove formed in an inner peripheral wall of the bearing portion.

8. The apparatus of claim 6, wherein the communication passage comprises a groove that extends radially through an inner location of the bearing portion.

9. The apparatus of claim 6, wherein the rear member and the timing pulley comprise a single component.

10. The apparatus of claim 6, wherein the communication passage comprises, in part, a groove formed on an inner peripheral wall of the timing pulley.

11. The apparatus of claim 6, wherein the driven side rotating arrangement includes a vane rotor rotatably mounted within the housing and including a plurality of vanes each extending outwardly therefrom between adjacent ones of the plurality of shoes.

12. The apparatus of claim 11, wherein the plurality of oil chambers comprises a plurality of lagging oil pressure chambers defined between a first side of each of the plurality of vanes and a first adjacent one of the plurality of shoes, and a plurality of leading oil pressure chambers defined between a second side of each of the plurality of vanes and a second adjacent one of the plurality of shoes.

13. The apparatus of claim 5, wherein the piston includes a forward taper portion for engagement with the engagement bore, and a rear flange that slidably engages a piston bearing wall.

14. The apparatus of claim 13, wherein the plurality of oil pressure chambers comprises:

a front oil pressure chamber, in communication with the forward taper portion and one of the plurality of leading oil pressure chambers, that suppresses vibration of the piston when oil is provided therein at a predetermined pressure;

a side oil pressure chamber in communication with one of the plurality of lagging oil pressure chambers, and with the rear flange, that causes withdrawal of the piston from the engagement bore as the driven side and driving side arrangements rotate from a most lagging position, when oil is provided therein at a predetermined pressure; and a back pressure chamber in communication with the rear flange of the piston and the oil lubrication space that allows the piston to move axially when the piston engages the engagement bore, and that is sealed from communication with the oil lubrication space when the piston is withdrawn from the engagement bore.

15. The apparatus of claim 13, wherein the plurality of oil pressure chambers comprises:

a front oil pressure chamber in communication with the forward tapered portion and one of the plurality of lagging oil pressure chambers that suppresses vibration of the piston when oil is provided therein at a predetermined pressure;

a side oil pressure chamber in communication with one of the plurality of leading oil pressure chambers, and with the rear flange, that causes withdrawal of the piston from the engagement bore as the driven side and driving side arrangements rotate from a most lagging position, when oil is provided therein at a predetermined pressure; and a back pressure chamber in communication with the rear flange of the piston and the oil lubrication space that allows the piston to move axially when the piston engages the engagement bore, and that is sealed from communication with the oil lubrication space when the piston is withdrawn from the engagement bore.

* * * * *